US010702979B2

(12) United States Patent
Chen

(10) Patent No.: US 10,702,979 B2
(45) Date of Patent: Jul. 7, 2020

(54) TORQUE ADJUSTMENT DEVICE FOR TORQUE WRENCH

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 197 days.

(21) Appl. No.: 16/048,360

(22) Filed: Jul. 30, 2018

(65) Prior Publication Data

US 2020/0030950 A1 Jan. 30, 2020

(51) Int. Cl.
*B25B 23/142* (2006.01)
*B25B 23/00* (2006.01)

(52) U.S. Cl.
CPC ..... *B25B 23/1427* (2013.01); *B25B 23/0007* (2013.01)

(58) Field of Classification Search
CPC ..... B25B 23/1417; B25B 23/0007; B25B 23/141
See application file for complete search history.

(56) References Cited

U.S. PATENT DOCUMENTS 9,056,391 B1 * 6/2015 Wu ..... B25B 23/141
2012/0103148 A1 * 5/2012 Lin ..... B25B 15/00 81/475
2017/0028539 A1 * 2/2017 Hsieh ..... B25B 23/1427

* cited by examiner

*Primary Examiner* — David B. Thomas

(57) ABSTRACT

A torque adjustment device of a torque wrench includes a handle having a passage defined axially therethrough, and a driving head is connected to one end of the handle. A torque adjustment unit is located in the passage of the handle and includes a stationary member, a threaded shaft threadedly extending through the stationary member, a rotary member and a spring. The shaft includes a threaded rod that extends beyond the rotary member. A sleeve is mounted to the threaded shaft. A rotary unit includes a tube which has a mounting section and a threaded section on two ends thereof. By rotating the tube, the rotary member and the threaded shaft are rotated relative to the stationary member so as to compress the spring to set the output torque value. A knob is then threadedly connected to the threaded rod to secure the output torque value.

7 Claims, 9 Drawing Sheets

TORQUE ADJUSTMENT DEVICE FOR TORQUE WRENCH

BACKGROUND OF THE INVENTION

1. Fields of the Invention

The present invention relates to a torque adjustment device for a torque wrench, and more particularly, to a torque adjustment device that is able to lock the set torque value during use.

2. Descriptions of Related Art

The conventional torque wrenches generally is used to apply precisely a specific torque to a fastener such as a nut or bolt. It includes a special internal mechanisms to allow the users to be acknowledged a pre-set torque value is reached. Nevertheless, the pre-set value to the torque wrench can be changed by unexpected or unintentional impact or operation. Once the pre-set value is changed, and the users are noticed the change, the users have to adjust the torque wrench again to prevent the nut or the bolt being damaged due to improper torque is applied.

The present invention is intended to provide a torque adjustment device of a torque wrench, and the torque adjustment device is designed to eliminate the drawbacks mentioned above.

SUMMARY OF THE INVENTION

The present invention relates to a torque adjustment device of a torque wrench, and comprises a handle having a passage defined axially therethrough. A driving head is connected to the first end of the handle, and a slot is defined axially through the wall of the second end of the handle.

A torque adjustment unit is located in the passage of the handle and includes a stationary member connected to the inner surface of the handle, a threaded shaft threadedly extending through the stationary member, a rotary member and a spring. The threaded shaft has a push end on the first end thereof. The rotary member is threadedly mounted to the second end of the threaded shaft and has outer threads defined in the outer periphery thereof. A threaded rod extends from the second end of the threaded shaft and extends beyond the rotary member. Multiple locking pins axially extend through the rotary member. Two ends of each locking pin extend beyond two ends of the rotary member. The spring is biased between the driving head and the push end.

A sleeve is mounted to the threaded shaft and located between the stationary member and the rotary member. The sleeve contacts the rotary member and is located corresponding to the locking pins. The sleeve has a guide pin which radially protrudes beyond the sleeve, and the guide pin extends through the slot of the handle so as to restrict the sleeve from spinning.

A rotary unit has a tube and a nut. The tube includes a mounting section on the first end thereof, and a threaded section is defined in the inner periphery of the second end of the tube. The threaded section is threadedly connected to the outer threads of the rotary member. The mounting section is mounted to the handle. The nut is threadedly connected to the outer threads of the rotary member and located opposite to the threaded section of the tube. The nut contacts the tube.

A knob is threadedly connected to threaded rod that extends beyond the rotary member. When the knob is removed from the threaded rod and the tube is rotated which drives the rotary member and the threaded shaft to rotate relative to the stationary member. The push end is moved to compress the spring so as to set an output torque value of the torque wrench. The rotary member drives the sleeve to move axially to change position of the guide pin relative to the slot. The knob is then rotated to urge the locking pins to contact against the sleeve so as to secure the output toque value.

Preferably, the stationary member is located between the driving head and the slot. The push end of the threaded shaft is located between the stationary member and the spring. The rotary member is located between the sleeve and the knob.

Preferably, the stationary member includes multiple recesses defined in the outer periphery thereof. Multiple fixing pins extend through the wall of the handle and are inserted into the recesses.

Preferably, the sleeve includes two lugs that are inserted into the passage of the handle, wherein the threaded shaft is located between the two lugs. The guide pin is engaged with one of the lugs.

Preferably, the handle includes torque value marks marked on the outer periphery thereof. The toque value marks are located between the driving head and the slot. The mounting section of the tube is located at a position relative to one of the toque value marks.

Preferably, the rotary member includes a receiving space defined in one end thereof. Multiple pin holes are defined in the inner end of the receiving space and communicate with the receiving space. The locking pins extend through the pin holes.

Preferably, the knob includes a threaded hole defined therein. A push portion extends from one end of the knob so as to contact the locking pins. The threaded rod is threadedly connected to the threaded hole of the knob. The push portion is located in the receiving space and contacts one of the two ends of each of the locking pins, and the other second end of each locking pin extends beyond the rotary member and contacts the sleeve to restrict the sleeve and the torque adjustment unit from moving and rotating.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
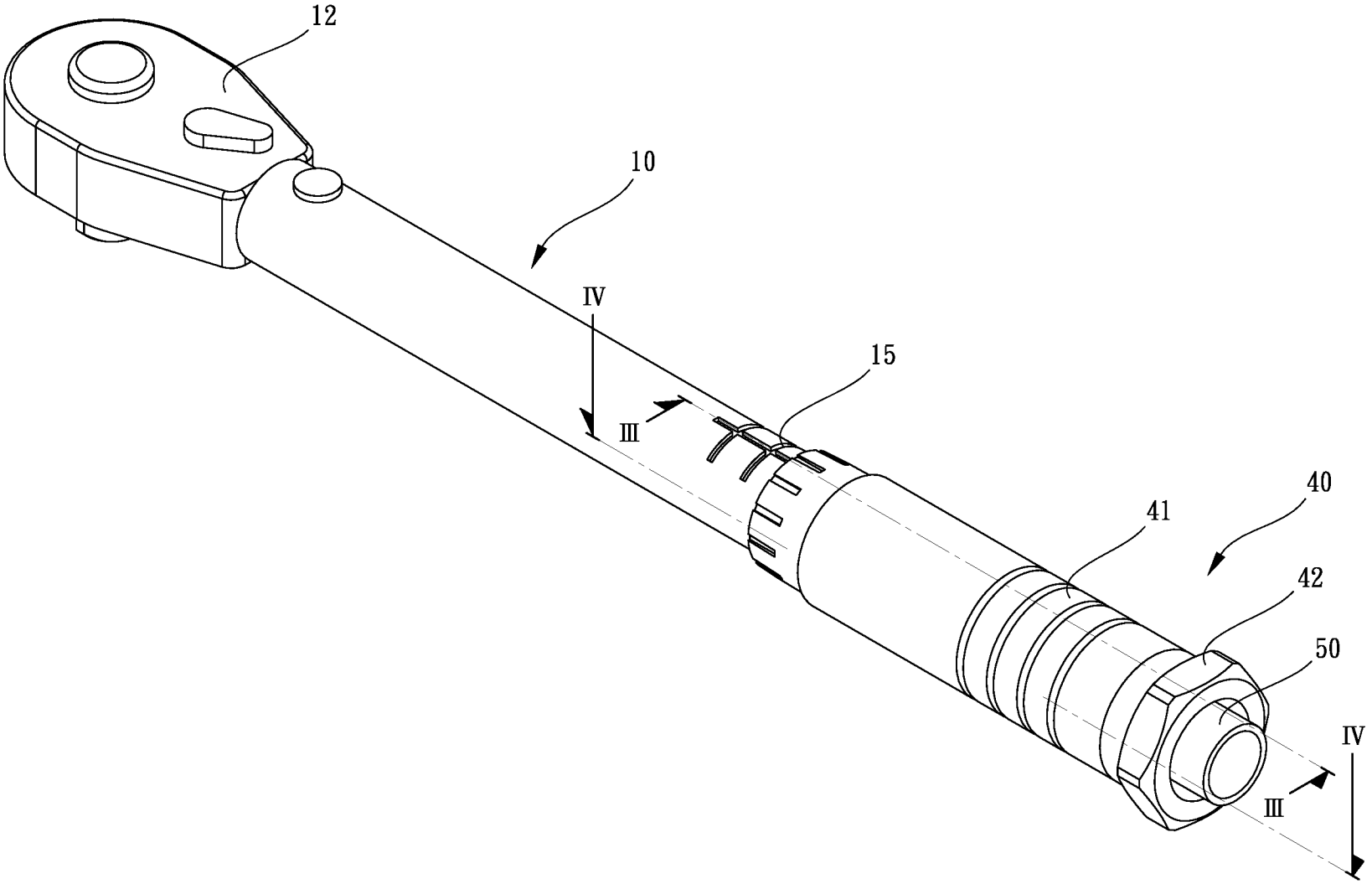
FIG. 1 is a perspective view to show a torque wrench in which the torque adjustment device of the present invention is installed.
Figure 2:
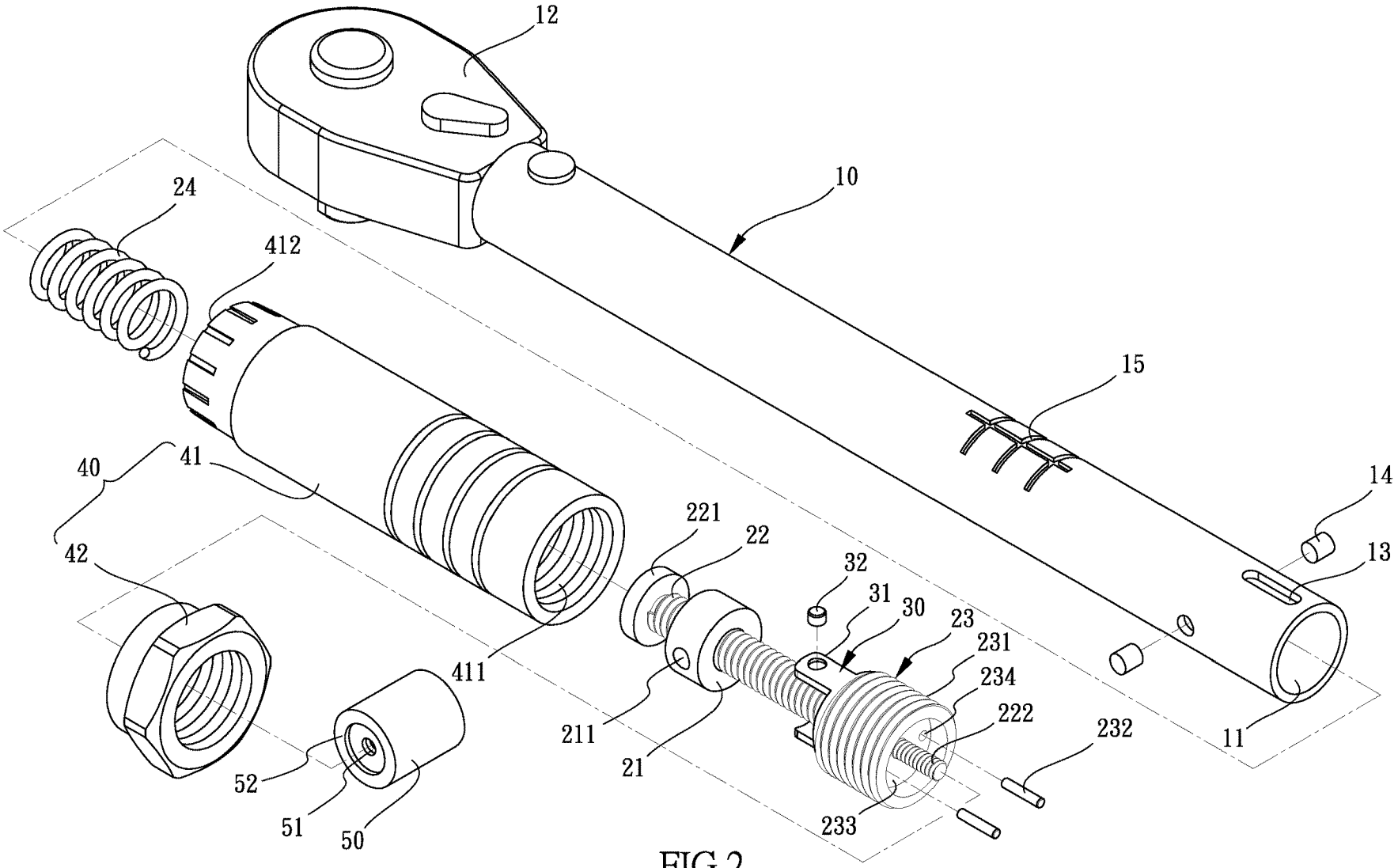
FIG. 2 is an exploded view of the torque wrench and the torque adjustment device of the present invention.

Referring to FIGS. 1 to 7, the torque adjustment device of a torque wrench comprises a handle 10 having a passage 11 defined axially therethrough. A driving head 12 is connected to the first end of the handle 10, and a slot 13 is defined axially through the wall of the second end of the handle 10. The handle 10 further includes torque value marks 15 marked on the outer periphery thereof. The toque value marks 15 are located between the driving head 12 and the slot 13.

Figure 3:
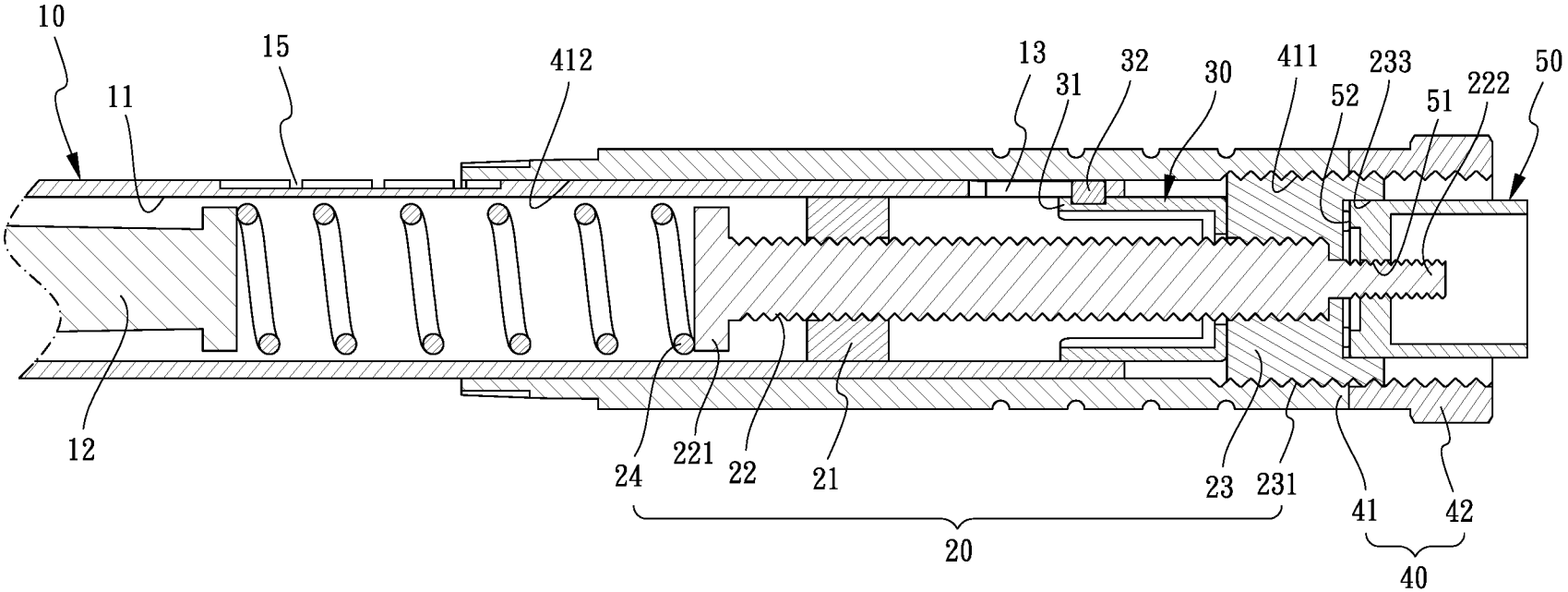
FIG. 3 is an cross sectional view, taken along line III-III of FIG. 1.
Figure 4:
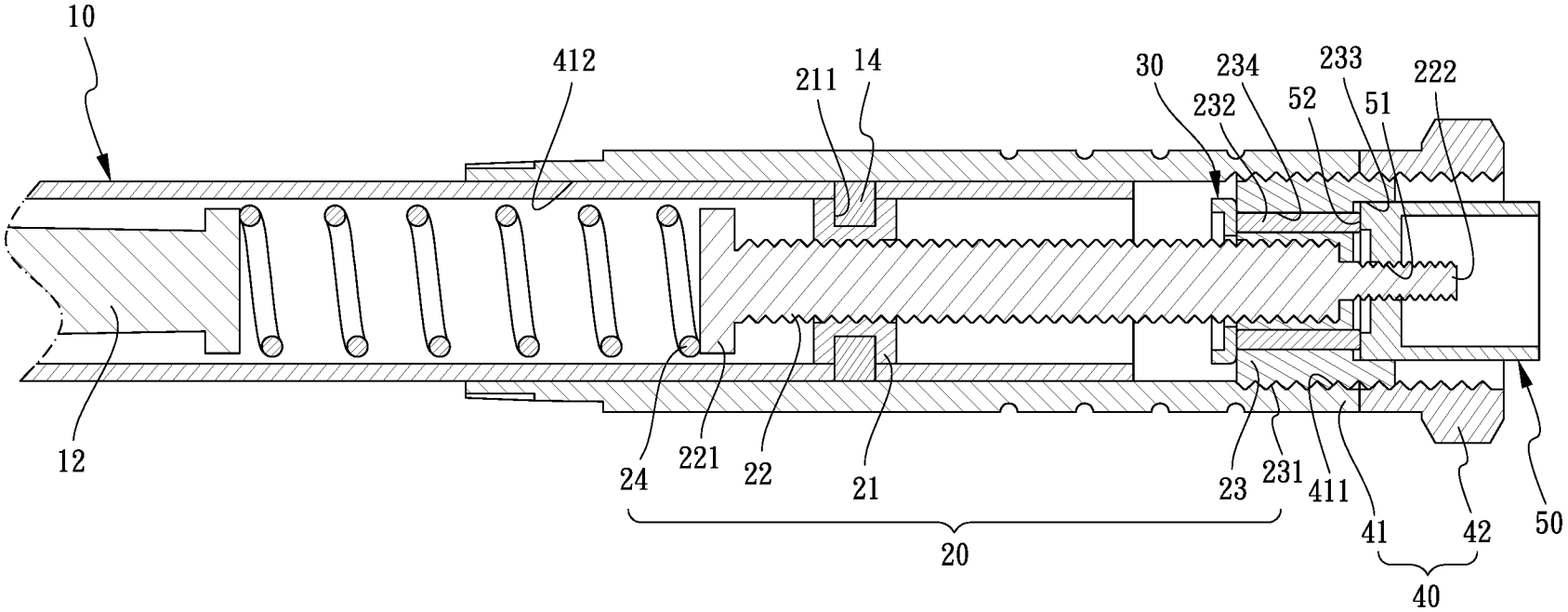
FIG. 4 is an cross sectional view, taken along line VI-VI of FIG. 1.

As shown in FIGS. 3 and 4, a torque adjustment unit 20 is located in the passage 11 of the handle 10 and includes a stationary member 21 securely connected to the inner surface of the handle 10, a threaded shaft 22 threadedly extending through the stationary member 21, a rotary member 23 and a spring 24. The stationary member 21 is located between the driving head 12 and the slot 13. The stationary member 21 includes multiple recesses 211 defined in the outer periphery thereof. Multiple fixing pins 14 extend through the wall of the handle 10 and inserted into the recesses 211. The threaded shaft 22 includes a push end 221 on the first end thereof, and the rotary member 23 is threadedly mounted to the second end of the threaded shaft 22. The push end 221 of the threaded shaft 22 is located between the stationary member 21 and the spring 24. The rotary member 23 includes outer threads 231 defined in the outer periphery thereof. A threaded rod 222 extends from the second end of the threaded shaft 22 and extends beyond the rotary member 23. The rotary member 23 includes a receiving space 233 defined in one end thereof which is located opposite to the push end 221. Multiple pin holes 234 are defined in the inner end of the receiving space 233 and communicate with the receiving space 233. The locking pins 232 axially extend through the pin holes 234. Two ends of each locking pin 232 extend beyond two ends of the rotary member 23. The spring 24 is biased between the driving head 12 and the push end 221.

A sleeve 30 is mounted to the threaded shaft 22 and located between the stationary member 21 and the rotary member 23. The sleeve 30 contacts the rotary member 23 and is located corresponding to the locking pins 232. The sleeve 30 has a guide pin 32 which radially protrudes beyond the sleeve 30. The guide pin 32 extends through the slot 13 of the handle 10 so as to restrict the sleeve 30 from spinning. Specifically, the sleeve 30 includes two lugs 31 that are inserted into the passage 11 of the handle 10. The threaded shaft 22 is located between the two lugs 31. The guide pin 32 is engaged with a notch defined in one of the lugs 31.

A rotary unit 40 has a tube 41 and a nut 42. The tube 41 includes a mounting section 412 on the first end thereof, and a threaded section 411 is defined in the inner periphery of the second end of the tube 41. The threaded section 411 is threadedly connected to the outer threads 231 of the rotary member 23. The mounting section 412 is mounted to the handle 10. The nut 42 is threadedly connected to the outer threads 231 of the rotary member 23 and located opposite to the threaded section 411 of the tube 41. The nut 42 contacts the tube 41.

A knob 50 is threadedly connected to threaded rod 222 that extends beyond the rotary member 23. The rotary member 23 is located between the sleeve 30 and the knob 50. The knob 50 includes a threaded hole 51 defined therein, and a push portion 52 extends from one end of the knob 50 so as to contact the locking pins 232. The threaded rod 222 is threadedly connected to the threaded hole 51 of the knob 50. The push portion 52 is located in the receiving space 233 and contacts one of the two ends of each of the locking pins 232, and the other end of each locking pin 232 extends beyond the rotary member 23 and contacts the sleeve 30 to restrict the sleeve 30 and the torque adjustment unit 20 from moving and rotating.

Figure 5:
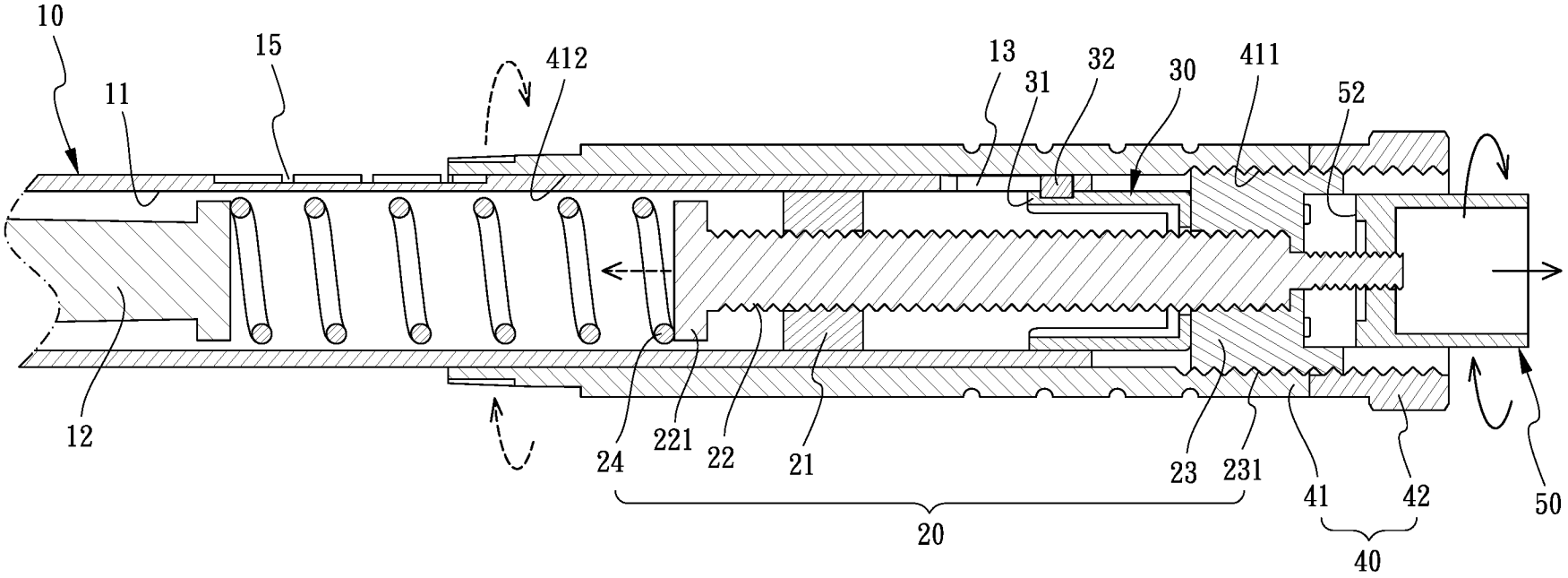
FIG. 5 shows that the knob is unscrewed.
Figure 6:
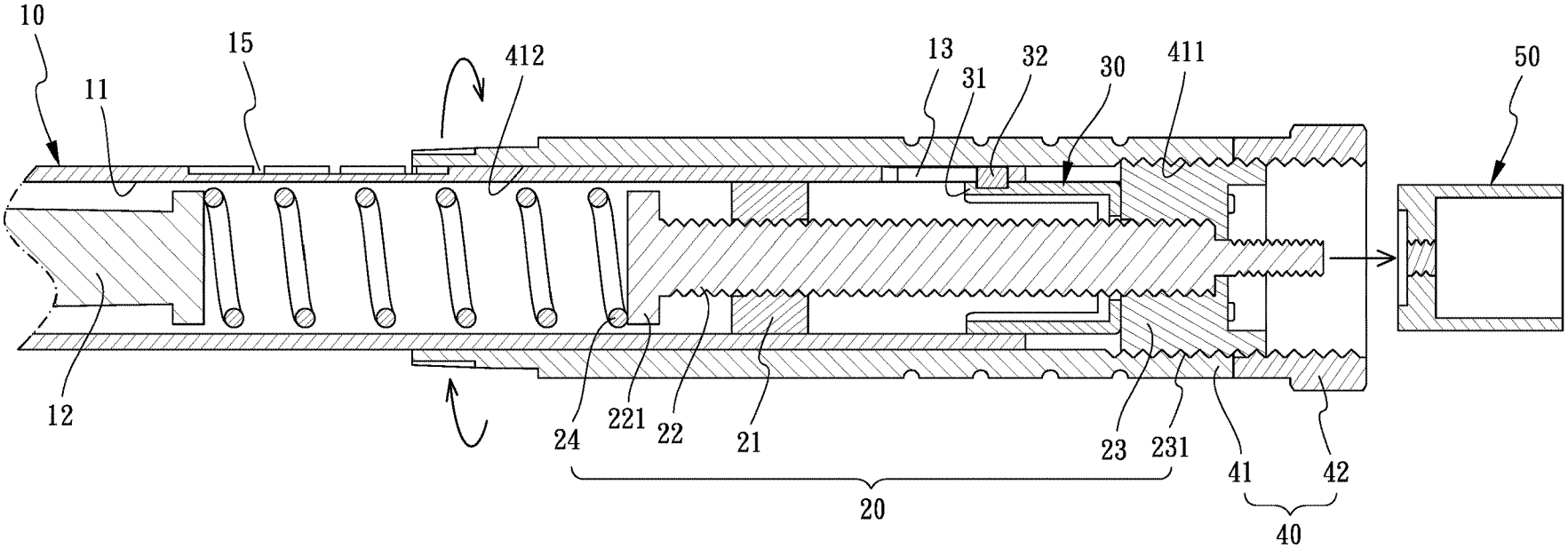
FIG. 6 shows that the torque adjustment device of the present invention is operated.
Figure 7:
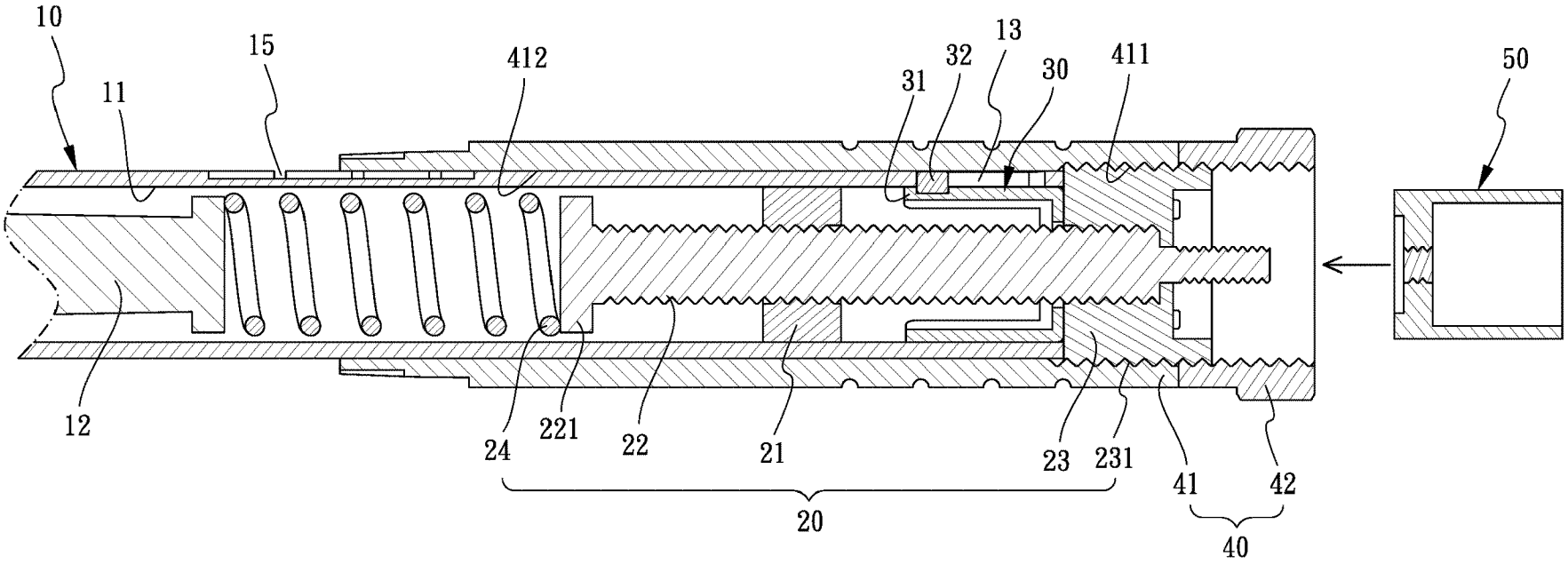
FIG. 7 shows that the torque adjustment device of the present invention is adjusted.

As shown in FIGS. 4-7, when the knob 50 is unscrewed along the direction opposite to the driving head 12 as shown in FIG. 5, the locking pins 232 are released and the sleeve 30 is not pushed by the locking pins 232. The knob 50 may be removed from the threaded rod 222. The tube 41 is rotated along the phantom lines as shown in FIG. 5 and drives the rotary member 23 and the threaded shaft 22 to rotate relative to the stationary member 21, and threaded shaft 22 moves in the passage 11 as shown in FIG. 6. The push end 221 is moved to compress the spring 24 as shown in FIG. 7 so as to set an output torque value of the torque wrench. In the meanwhile, the rotary member 23 drives the sleeve 30 to move axially to change position of the guide pin 32 relative to the slot 13.

Figure 8:
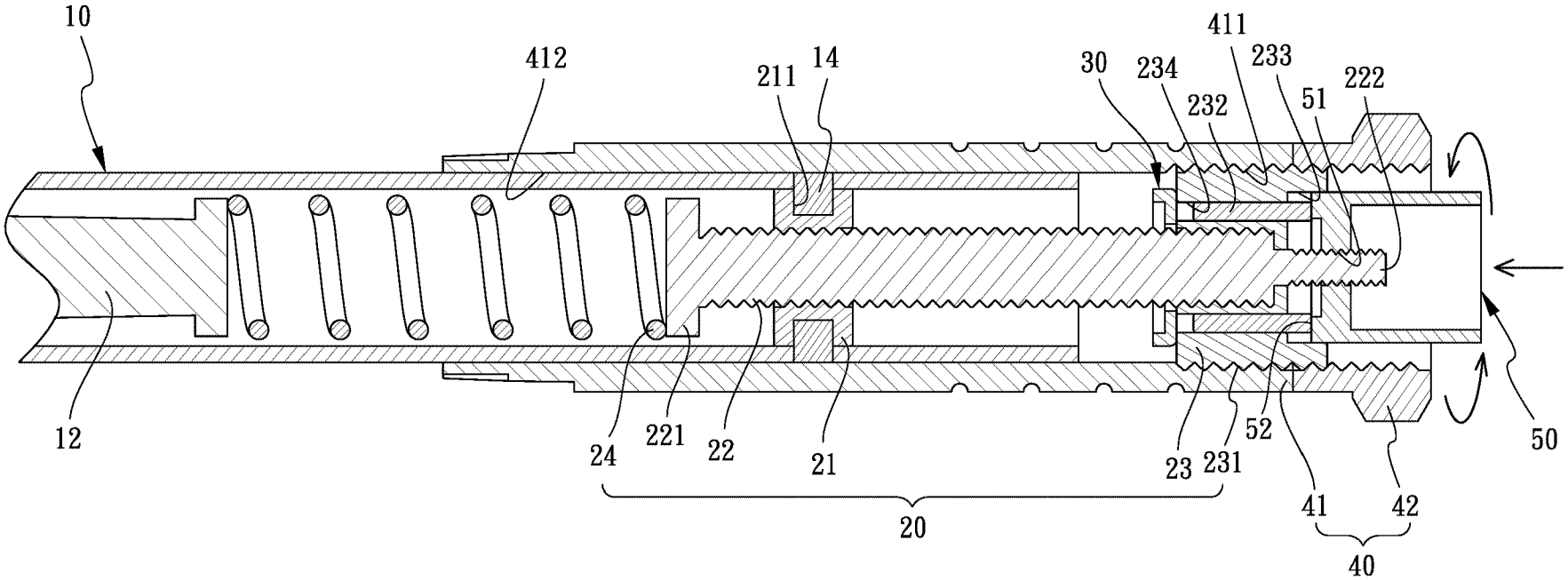
FIG. 8 shows that the knob is re-connected to the threaded rod again.
Figure 9:
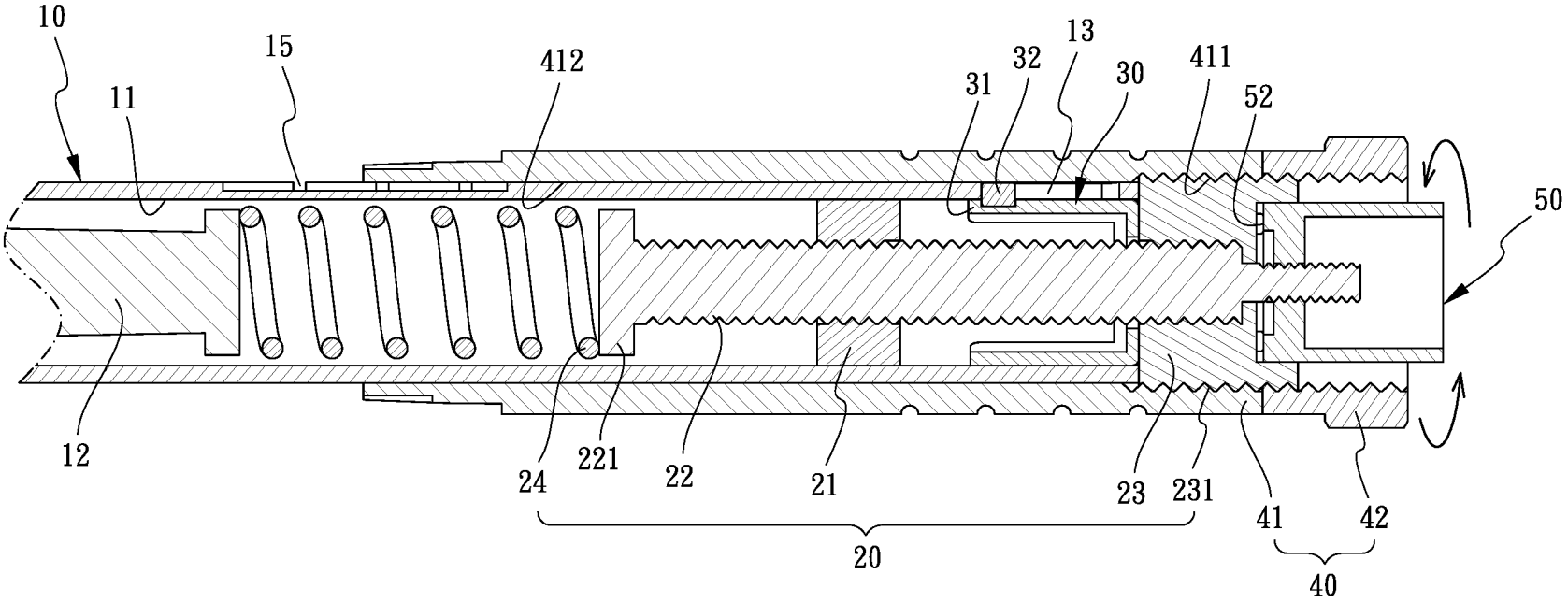
FIG. 9 shows that the knob is connected to the threaded rod to secure the output torque value.

As shown in FIGS. 8 and 9, the knob 50 is then reconnected to the threaded rod 222 and rotated to urge the locking pins 232 to let the push portion 52 contact against the locking pins 232 which then contact against the sleeve 30 to secure the output toque value because the sleeve 30 and the torque adjustment unit 20 cannot be rotated. The mounting section 412 of the tube 41 is located at a position relative to one of the toque value marks 15 to let the user know the desired torque value is set.

While we have shown and described the embodiment in accordance with the present invention, it should be clear to those skilled in the art that further embodiments may be made without departing from the scope of the present invention.

What is claimed is:

1. A torque adjustment device of a torque wrench, comprising:

a handle (10) having a passage (11) defined axially therethrough, a driving head (12) connected to a first end of the handle (10), a slot (13) defined axially through a wall of a second end of the handle (10);

a torque adjustment unit (20) located in the passage (11) of the handle (10) and having a stationary member (21) connected to an inner surface of the handle (10), a threaded shaft (22) threadedly extending through the stationary member (21), a rotary member (23) and a spring (24), the threaded shaft (22) having a push end (221) on a first end thereof, the rotary member (23) threadedly mounted to a second end of the threaded shaft (22) and having outer threads (231) defined in an outer periphery thereof, a threaded rod (222) extending from the second end of the threaded shaft (22) and extending beyond the rotary member (23), multiple locking pins (232) axially extending through the rotary member (23), two ends of each locking pin (232) extending beyond two ends of the rotary member (23), the spring (24) biased between the driving head (12) and the push end (221);

a sleeve (30) mounted to the threaded shaft (22) and located between the stationary member (21) and the rotary member (23), the sleeve (30) contacting the rotary member (23) and located corresponding to the locking pins (232), the sleeve (30) having a guide pin (32) which radially protrudes beyond the sleeve (30), the guide pin (32) extending through the slot (13) of the handle (10) so as to restrict the sleeve (30) from spinning;

a rotary unit (40) having a tube (41) and a nut (42), the tube (41) including a mounting section (412) on a first end thereof, a threaded section (411) defined in an inner periphery of a second end of the tube (41), the threaded section (411) threadedly connected to the outer threads (231) of the rotary member (23), the mounting section (412) mounted to the handle (10), the nut (42) threadedly connected to the outer threads (231) of the rotary member (23) and located opposite to the threaded section (411) of the tube (41), the nut (42) contacting the tube (41), and a knob (50) threadedly connected to threaded rod (222) that extends beyond the rotary member (23), wherein when the knob (50) is removed from the threaded rod (222) and the tube (41) is rotated which drives the rotary member (23) and the threaded shaft (22) to rotate relative to the stationary member (21), the push end (221) is moved to compress the spring (24) so as to be adapted to set an output torque value of the torque wrench, the rotary member (23) drives the sleeve (30) to move axially to change position of the guide pin (32) relative to the slot (13), the knob (50) is then rotated to urge the locking pins (232) to contact against the sleeve (30) so as to be adapted to secure the output toque value.

2. The torque adjustment device of a torque wrench as claimed in claim 1, wherein the stationary member (21) is located between the driving head (12) and the slot (13), the push end (221) of the threaded shaft (22) is located between the stationary member (21) and the spring (24), the rotary member (23) is located between the sleeve (30) and the knob (50).

3. The torque adjustment device of a torque wrench as claimed in claim 1, wherein the stationary member (21) includes multiple recesses (211) defined in an outer periphery thereof, multiple fixing pins (14) extend through the wall of the handle (10) and inserted into the recesses (211).

4. The torque adjustment device of a torque wrench as claimed in claim 3, wherein the sleeve (30) includes two lugs (31) that are inserted into the passage (11) of the handle (10), the threaded shaft (22) is located between the two lugs (31), the guide pin (32) is engaged with one of the lugs (31).

5. The torque adjustment device of a torque wrench as claimed in claim 1, wherein the handle (10) includes torque value marks (15) marked on an outer periphery thereof, the toque value marks (15) are located between the driving head (12) and the slot (13), the mounting section (412) of the tube (41) is located at a position relative to one of the toque value marks (15).

6. The torque adjustment device of a torque wrench as claimed in claim 5, wherein the rotary member (23) includes a receiving space (233) defined in one end thereof, multiple pin holes (234) are defined in an inner end of the receiving space (233) and communicate with the receiving space (233), the locking pins (232) extend through the pin holes (234).

7. The torque adjustment device of a torque wrench as claimed in claim 6, wherein the knob (50) includes a threaded hole (51) defined therein, a push portion (52) extends from one end of the knob (50) so as to contact the locking pins (232), the threaded rod (222) is threadedly connected to the threaded hole (51) of the knob (50), the push portion (52) is located in the receiving space (233) and contacts one of the two ends of each of the locking pins (232), and the other end of each locking pin (232) extends beyond the rotary member (23) and contacts the sleeve (30) to restrict the sleeve (30) and the torque adjustment unit (20) from moving and rotating.

* * * * *